US005402943A

United States Patent [19]

King et al.

[11] Patent Number: 5,402,943

[45] Date of Patent: Apr. 4, 1995

[54] METHOD OF ATOMIZING INCLUDING INDUCING A SECONDARY FLOW

[75] Inventors: Anthony W. King; Stephen T. Dunne, both of Ipswich, England

[73] Assignee: DMW (Technology) Limited, United Kingdom

[21] Appl. No.: 66,118

[22] PCT Filed: Dec. 4, 1991

[86] PCT No.: PCT/GB91/02145

§ 371 Date: Jun. 4, 1993

§ 102(e) Date: Jun. 4, 1993

[87] PCT Pub. No.: WO92/10301

PCT Pub. Date: Jun. 25, 1992

[30] Foreign Application Priority Data

Dec. 4, 1990 [GB] United Kingdom ..... 9026299
Apr. 30, 1991 [GB] United Kingdom ..... 9109293

[51] Int. Cl.[6] ..... B05B 17/04; B05B 1/26

[52] U.S. Cl. ..... 239/11; 239/518; 239/521; 239/596

[58] Field of Search ..... 239/11, 518, 521, 523, 239/524, 596, 597, 598, 328, 340, 327, 373

[56] References Cited

U.S. PATENT DOCUMENTS

| | | | |
|---|---|---|---|
| 334,110 | 1/1886 | Delaney | 239/521 |
| 460,458 | 9/1891 | Bates . | |
| 1,035,261 | 8/1912 | Strumpf . | |
| 1,116,536 | 11/1914 | Ballreich | 239/598 |
| 1,276,245 | 8/1918 | Millard et al. | 239/597 X |
| 1,838,873 | 12/1931 | Scott . | |
| 2,024,339 | 12/1935 | Connell | 239/521 |
| 2,045,190 | 6/1936 | Kellner | 239/328 |
| 2,052,869 | 9/1936 | Coanda | 239/521 X |
| 2,187,779 | 1/1940 | Gardner | 239/DIG. 19 X |
| 2,432,791 | 12/1947 | Osses . | |
| 2,673,123 | 3/1954 | Benoit et al. | 239/598 X |
| 2,676,845 | 4/1954 | Rathsprecher . | |
| 2,786,656 | 3/1957 | Corneil . | |
| 3,187,748 | 6/1965 | Mitchell et al. . | |
| 3,330,277 | 7/1967 | Gabriels . | |
| 3,396,874 | 8/1968 | Malone . | |
| 3,421,662 | 1/1969 | Hanson . | |
| 3,471,065 | 10/1969 | Malone . | |
| 3,575,322 | 4/1971 | Jordon . | |
| 3,605,738 | 9/1971 | Ciranna . | |
| 3,628,875 | 12/1971 | Wild . | |
| 3,790,034 | 2/1974 | Horvath . | |
| 3,797,748 | 3/1974 | Nozawa et al. . | |
| 3,831,861 | 8/1974 | Hanson, Jr. . | |
| 3,838,686 | 10/1974 | Szekely . | |
| 3,878,973 | 4/1975 | Riccio . | |
| 3,893,628 | 7/1975 | McCollum | 239/521 |
| 3,921,857 | 11/1975 | Riccio . | |
| 3,921,861 | 11/1975 | Kondo . | |
| 3,921,916 | 11/1975 | Bassous | 239/DIG. 19 X |
| 3,923,202 | 12/1975 | Riccio . | |
| 3,933,279 | 1/1976 | Maier . | |
| 4,007,855 | 2/1977 | Hierath et al. . | |
| 4,017,007 | 4/1977 | Riccio . | |

(List continued on next page.)

FOREIGN PATENT DOCUMENTS 2017366 11/1990 Canada .

(List continued on next page.)

OTHER PUBLICATIONS

Fundamentals of Motor Vehicle Technology, V.A.W. Hillier and F. Pittuck, 3rd Edition, pp. 208–209.

*Primary Examiner*—William Grant
*Attorney, Agent, or Firm*—Sterne, Kessler Goldstein & Fox

[57] ABSTRACT

A method for discharging a fluid, notably an aqueous medicament solution, as a spray of droplets by causing a fluid to flow through a nozzle aperture so that a secondary flow is induced in at least part of the flow of fluid through the nozzle aperture by a flap or orifice lip located within the bore of the nozzle passage, and/or adjacent an end of the nozzle passage, and/or adjacent the nozzle aperture. Preferably a secondary flow at the nozzle orifice is induced such that at least 10% of the fluid flows at an exit angle of 90° to the overall line of travel of the remainder of the fluid.

10 Claims, 4 Drawing Sheets

U.S. PATENT DOCUMENTS

| | | | |
|---|---|---|---|
| 4,147,476 | 4/1979 | Warren . | |
| 4,167,941 | 9/1979 | Capra et al. . | |
| 4,183,449 | 1/1980 | Blake . | |
| 4,260,082 | 4/1981 | Rooney et al. . | |
| 4,271,875 | 6/1981 | Meshberg . | |
| 4,345,718 | 8/1982 | Horvath . | |
| 4,414,972 | 11/1983 | Young et al. . | |
| 4,441,634 | 4/1984 | Meshberg . | |
| 4,506,497 | 3/1985 | Feuerlohn . | |
| 4,534,345 | 8/1985 | Wetterlin . | |
| 4,648,393 | 3/1987 | Landis et al. . | |
| 4,667,668 | 5/1987 | Wetterlin . | |
| 4,693,675 | 9/1987 | Venus, Jr. . | |
| 4,694,977 | 9/1987 | Graf et al. . | |
| 4,810,659 | 3/1989 | Higo et al. . | |
| 4,819,834 | 4/1989 | Thiel . | |
| 4,828,184 | 5/1989 | Gardner et al. | 239/596 X |
| 4,860,738 | 8/1989 | Hegemann et al. . | |
| 4,867,347 | 9/1989 | Wass et al. . | |
| 4,875,605 | 10/1989 | Weston . | |
| 4,892,232 | 1/1990 | Martin . | |
| 4,896,832 | 1/1990 | Howlett . | |
| 5,056,511 | 10/1991 | Ronge . | |
| 5,088,649 | 2/1992 | Hanson et al. . | |
| 5,115,981 | 5/1992 | Callahan et al. . | |

FOREIGN PATENT DOCUMENTS

| | | | |
|---|---|---|---|
| 0105964 | 4/1984 | European Pat. Off. . | |
| 0111875 | 6/1984 | European Pat. Off. . | |
| 0255208 | 2/1988 | European Pat. Off. . | |
| 0140477 | 5/1988 | European Pat. Off. . | |
| 0379818 | 8/1990 | European Pat. Off. . | |
| 2524348 | 10/1983 | France . | |
| 1803541 | 4/1970 | Germany . | |
| 2654227 | 6/1978 | Germany | 239/523 |
| 63-232866 | 9/1988 | Japan . | |
| 405458 | 2/1934 | United Kingdom . | |
| 931089 | 7/1963 | United Kingdom . | |
| 1014685 | 12/1965 | United Kingdom . | |
| 1239855 | 7/1971 | United Kingdom . | |
| 1279797 | 6/1972 | United Kingdom . | |
| 1291367 | 10/1972 | United Kingdom . | |
| 1389702 | 4/1975 | United Kingdom . | |
| 1481199 | 7/1977 | United Kingdom . | |
| 1493614 | 11/1977 | United Kingdom . | |
| 1556977 | 12/1979 | United Kingdom . | |
| 2041249 | 12/1982 | United Kingdom . | |
| 2209564 | 5/1989 | United Kingdom . | |
| 992070A | 9/1981 | U.S.S.R. . | |
| WO89/07244 | 8/1989 | WIPO . | |
| WO91/14468 | 10/1991 | WIPO . | |
| WO93/02729 | 2/1993 | WIPO . | |

METHOD OF ATOMIZING INCLUDING INDUCING A SECONDARY FLOW

The present invention relates to atomising nozzles, notably to ones which are configured so as to form significant secondary flows within the nozzle bore and/or at the nozzle orifice outlet so as enhance the formation of droplets of a mean size less than about 10 to 12 micrometers without the use of pressurised gas or liquified propellants to dispense a fluid through the nozzle.

BACKGROUND TO THE INVENTION

Atomising nozzles are used in a wide range of spray devices to break up a fluid into fine droplets so as to form a spray or mist of the fluid as it is discharged from the device. Where a medicament is to be administered deep into the lung of a user, the droplet size in such a spray should be less than 10 micrometers.

Currently, the accepted method for dispensing a fluid medicament uses a pressurised or liquefied propellant gas as the means for atomising the fluid medicament composition. The rapid expansion of the propellant at the nozzle orifice causes the atomization of the fluid into droplets of a sufficiently small size for administration of medicaments via the lungs. At present, the use of such propellant systems provides the only practical means for administering medicaments by this route using convenient hand portable devices. However, the use of such gases has a number of disadvantages, for example from environmental aspects or from the chilling sensations experienced by the user due to the rapid evaporation of the propellant from the composition, and the fact that many medicament formulations are incompatible with conventionally used propellants without the use of co-solvents and other additives, which may themselves be undesirable.

Many attempts have been made to avoid the use of such pressurised gases as propellants in medicament formulations, for example using mechanical means to atomise the fluid. Most such attempts have failed because they cannot achieve the very small droplet size required within a hand held device.

In order to assist break up of a stream or jet of fluid issuing from a nozzle orifice, it has been proposed that the stream or jet of fluid should strike an impingement surface placed some distance from the outlet of the nozzle assembly. Such devices may produce sprays in which some of the droplets have a small diameter, but many of the droplets will be of excessively large size for inhalation deep into the lung of a user, thus affecting the uptake of the medicament by the user. Furthermore, some of the fluid striking the impingement surface adheres to the surface. As a result, a fluctuating amount of any measured dose of the fluid is lost. In addition, the residual fluid adhering to the impingement surface can become contaminated and must be removed before the next dose of fluid strikes the surface. Such impingement mechanisms cannot therefore be used where a consistent and predetermined quantity of fluid is to be dispensed to a user, notably where the fluid contains a medicament which is to be inhaled deep into the lungs of a user.

It has also been proposed to pass the fluid through a swirl chamber located upstream of the inlet to the nozzle assembly. Such a swirl chamber imparts rotation to the fluid stream and causes the fluid to issue from the nozzle orifice as a swirling cone of fluid which readily breaks up into a spray of fine droplets. However, due to difficulties in manufacture, it has not proved commercially feasible to manufacture such a swirl chamber for small scale devices, for example those where a fluid is ejected under pressure without the aid of a pressurised gas stream through a very fine nozzle orifice. The use of a swirl chamber has therefore not provided a practical solution with small scale devices.

The present application relates to a configuration of nozzle assembly, notably of the nozzle orifice aperture itself, which assists production of a finely atomised spray by the creation of secondary flows, that is flows of fluid transverse to the main line of flow of fluid, at or adjacent the aperture to the nozzle orifice by inducing changes in the direction of flow of the fluid as it passes through the nozzle bore or aperture. Such nozzle assemblies enhance the production of very fine droplets in the spray, notably those with a mass median particle size less than 10 micrometers, and enhance the operation of mechanically operated devices for the production of atomised sprays to be inhaled deep into the lung of a user.

SUMMARY OF THE INVENTION

According to a first aspect, the invention provides a method for discharging a fluid as a spray of droplets by causing a fluid to flow through a nozzle assembly comprising a nozzle passage in fluid flow communication with a nozzle aperture, which method is characterised in that a secondary flow is induced in at least part of the flow of fluid through the nozzle aperture by a direction changing means located in the bore of the nozzle passage and/or at or immediately adjacent the nozzle aperture.

The invention also provides a nozzle assembly for use in the method of the invention, which nozzle assembly is characterised in that it comprises:

a. a nozzle member having one or more nozzle passages therein which are adapted to act as a conduit for fluid passing through the nozzle member and which are in fluid flow communication with a nozzle aperture;

b. one or more direction changing means, at least one of which means is located within said nozzle passage and/or at or immediately adjacent an end to said passage and/or at or immediately adjacent the nozzle aperture; which direction changing means is adapted to cause a change in the direction of flow of at least part of said fluid, whereby a secondary flow is induced into said part of said fluid flow; and c. a nozzle aperture through which aperture said flow of fluid is to be discharged as a spray of droplets.

The invention further provides a spray generating device having a spray-forming-nozzle outlet comprising a nozzle assembly according to the invention.

The degree of secondary flow at the nozzle aperture achieved by the direction changing means is dependent upon both the percentage of the flow whose direction is changed and the angle of such a change in direction with respect to the remainder of the fluid. Thus, secondary flow at 10° to the remainder will achieve an effect if sufficient percentage of the flow is diverted, whereas a smaller amount of the flow needs to be diverted at a larger angle to achieve the same effect. Furthermore, it will be appreciated that the degree of secondary flow may vary across the stream of fluid issuing from the nozzle aperture. For convenience, the secondary flow will be considered herein in terms of its resolved components parallel to and at 90° to the line of flow of the remainder of the fluid at the nozzle aperture and the amounts of the secondary flow quoted herein will be expressed in terms of that mean component of the redirected flow at an exit angle of 90° to the overall line of flow of the remainder of the fluid at the nozzle aperture. Preferably, the direction changing means achieves a secondary flow at the nozzle aperture which is equivalent to a mean of at least 10% of the fluid flowing at an exit angle of 90° to the overall line of flow of the remainder of the fluid at the nozzle aperture.

Preferably, the direction changing means induces a secondary flow at the nozzle aperture which is equivalent to a component of from 20 to 80%, for example 25 to 50%, of the fluid flowing at an exit angle of 90° to the overall line of flow of the remaining fluid.

The term immediately adjacent is used herein with respect to the location of the nozzle aperture and direction changing means to denote that those items are located sufficiently close to the nozzle passage for the fluid not to have sufficient length of travel to stabilise and damp out the secondary flows induced in it whereby preferably at least 10% secondary flow persists when the fluid exits the nozzle orifice aperture of the assembly.

The nozzle assembly of the invention finds use in a wide range of types of spray generating device, for example with conventional devices which use a liquified gas propellant or a blast of high pressure air as the propellant to atomise the fluid as it passes through the nozzle orifice. However, the nozzle assembly of the invention is of special application as the nozzle outlet to mechanically operated spray generating devices, which have hitherto been considered incapable of delivering very fine droplet sized sprays, notably those with a mass median droplet diameter of less than 10 micrometers. The invention is of special use with the type of device in which a fluid is ejected through the nozzle assembly under the pressure generated by a spring loaded pump mechanism, notably that described in our co-pending International Application No. PCT/GB 91/00433.

The nozzle assembly can take any suitable form having regard to the spray forming device with which it is used. Thus, the nozzle assembly can take the form of a discrete component which is mounted in the spray forming device. For example, where the fluid is ejected from a container under pressure using a pressurised propellant gas, the nozzle assembly can take the form of a metal nozzle insert which is a screw thread or other fit in the outlet to the outlet valve mechanism of the container. Alternatively, the nozzle assembly can form part of a cap or a trigger mechanism which actuates a mechanical device generating the pressure to discharge the fluid through the nozzle. In such a case, the nozzle passage of the assembly of the invention may be provided at least in part as a bore formed in the body of some other component of the spray forming device, for example as an outlet to the pressure chamber in which the fluid is pressurised for discharge to the nozzle orifice in the cap.

For convenience, the invention will be described hereinafter in terms of the nozzle assembly being a discrete nozzle member mounted terminally in a bore in a component of the spray forming device.

The nozzle passage can have any suitable shape and cross-section. Typically, the passage will be provided at least in part by the bore in the component upon which the nozzle orifice is mounted. This bore can be a generally circular cross-section bore in the component. However, the bore may have other shapes or configurations, for example squared, triangular or other polygonal cross-section and such polygonal or asymmetric cross-sectional shape may induce sufficient secondary flows within the fluid at the nozzle orifice aperture to achieve the desired degree of atomization of the fluid without the need for additional direction changing means elsewhere in the nozzle assembly. It is particularly preferred to use rectangular, cruciform or stellate cross-sectional shapes for the bore where the ratio of the maximum radial dimension to the minimum radial dimension is greater than 2:1, for example from 3:1 to 10:1.

The cross-sectional shape and area of the bore can vary along its length to induce a high degree of turbulence in the flow within the bore so as to achieve at least part of the secondary flow required in the present invention within this bore. In this case the bore can taper uniformly or step-wise or otherwise reduce towards the bore outlet to accelerate the flow of the fluid as it passes through the bore and to prevent stabilisation of laminar flow within the bore or the excessive damping out of turbulence within the bore to reduce the secondary flow to an ineffective amount, for example below 10%. Where the bore tapers uniformly, it will usually be necessary for the taper to have an included angle of at least 20°, preferably in excess of 60°, notably 90° or more, for the taper to induce sufficient secondary flow in the fluid passing through the nozzle passage. Alternatively, the taper can have sharp steps or changes in angle to induce the necessary secondary flow.

The inlet and/or outlet to the bore feeding the nozzle assembly of the invention may have the same or a different cross-sectional shape and size to the nozzle passage in the nozzle assembly and/or the main portion of the bore, as when a nozzle assembly having an irregular polygonal nozzle orifice aperture to generate the required secondary flow is a screw fit into a circular cross-section bore in the spray forming device.

As indicated above, the nozzle passage may be provided by a bore in a component of the spray forming device into which the nozzle orifice is mounted. However, part or all of the nozzle passage can be formed within the nozzle assembly, as when the nozzle orifice aperture is formed as an aperture in the end of a blind bore in a metal or jewel nozzle block and the nozzle passage is formed wholly within that nozzle block. In such a case, the bore in the spray forming device serving the nozzle orifice can be a conventional smooth walled circular cross-section bore and the nozzle passage can have any of the configurations described above for the bore in the spray device.

Where the shape and configuration of the nozzle passage is used to achieve the required secondary flow(s) in the flow of fluid through the nozzle orifice aperture, the length of any smooth walled straight circular cross-section portion the passage should not be sufficiently great for the flow of fluid to stabilise within the passage. It is therefore preferred that the bore length (l) to maximum diameter (d) ratio for such a portion be less than 2:1, notably less than 1:1, for example from 0.25:1 to 1:1. However, where the shape or configuration of a portion of the nozzle passage achieves adequate secondary flow(s), the l:d ratio of such a portion can be comparatively large, for example 5:1 or more, e.g. from 10:1 to 100:1.

For convenience, the invention will be described hereinafter in terms of a generally circular uniform cross-section bore in the spray forming device having a nozzle assembly of the invention mounted terminally therein.

The nozzle assembly of the present invention is characterised in that is it provided with means for changing the direction of flow of at least part of the fluid in the stream of fluid flowing through it, so as to induce one or more secondary flow components within the main stream of fluid as it passes through the nozzle passage and/or the nozzle orifice aperture. The invention is thus distinguished from the use of a swirl chamber at or upstream of the nozzle passage inlet which induces a rotational component to the whole of the fluid flow which is accentuated as the flow is accelerated into the nozzle passage.

The direction changing means can be provided in a number of manners. For example, the geometry of the axial or transverse cross-section of the nozzle passage described above may be sufficient to cause the formation of sufficient secondary flows within the fluid flowing through the passage for further direction changing means not to be required. Where this is not the case, the passage can be formed with one or more sharp angled bends in its length which cause changes in the direction of flow within the nozzle assembly. Sudden changes in cross-sectional area of the nozzle passage may achieve the same effect, as when a plenum chamber is provided between two transverse plates each having a sharp lipped orifice aperture therein, for example as with a de Bono type whistle; or when the taper of the nozzle passage is formed with a series of circumferential ribs or steps. Alternatively, the walls of the nozzle passage can be rough so as to induce drag and turbulence in the layer of fluid adjacent the nozzle passage wall and thus induce high differences in flow speed and direction within the fluid. Such roughness can be achieved by forming the nozzle passage by conventional machining techniques, for example drilling or punching the nozzle passage in a metal, and omitting the finishing and polishing steps hitherto considered necessary in the formation of passages in conventional nozzle assemblies. The degree of roughness achieved in this manner is typically of the order of from 1 to 5 micrometers variation about the mean plane of the surface and the radial height of the roughness will typically be from 10 to 50% of the nozzle passage diameter. In a further alternative, turbulators can be formed within the bore of the nozzle passage, for example as finned or roughened axial inserts within the bore.

The shape and configuration of the nozzle passage may induce sufficient secondary flow in the fluid flowing through the nozzle orifice aperture for it to be possible to use a conventional smooth lipped circular nozzle orifice aperture which itself induces little or no additional secondary flow. However, it is particulary preferred that the direction changing means be located at or immediately adjacent to the nozzle orifice aperture or be incorporated in the nozzle orifice itself by suitable design of the shape of the orifice aperture. Thus, for example, the nozzle orifice can be provided with an additional component, for example a flap or flow guide, located in or immediately adjacent to the orifice aperture. Such a flap or flow guide can act upon part or all of the flow of fluid. However, it is preferred that the flap or guide act upon only part, for example from 10 to 80% of the effective cross-section of the flow of fluid so as to cause that affected flow to impinge upon the unaffected remainder of the flow.

Alternatively, the secondary flow can be achieved by the use of an orifice aperture with an irregular or polygonal plan shape, for example a triangular or rectangular aperture, notably with sharp angles, which need not be radially symmetrical, for example a stellate shaped aperture.

Preferably, the nozzle orifice aperture will have a knife edge lip to maximise the rate of change of direction of fluid passing the lip and any angles in the circumferential periphery of the lip are kept as sharp as practical. It is also preferred that the ratio of the maximum radial dimension to the minimum radial dimension of the orifice aperture be at least 2:1, notably 3:1 to 10:1. Furthermore, it is not necessary that the aperture of the orifice be radially symmetrical.

The nozzle aperture preferably has a mean diameter less than 100 micrometers, preferably less than 20 micrometers where droplets with a mass median diameter of less than about 6 micrometers are to be produced.

Such nozzle orifice apertures can be formed by conventional techniques, for example by photoresist or electrochemical etching of a metal or other plate or by the use of a laser beam to form a rough but generally circular aperture in the plate or in a jewel nozzle block, or by mechanical stamping, pressing, drilling or other means. Thus, for example, the nozzle aperture can be formed as a square or rectangular aperture in a silicon laminate by chemically etching one face of a suitable wafer and a conical nozzle passage forming the inlet to the orifice aperture formed by etching the laminate from the other face.

The direction changing means have been described above in terms of devices which act radially inwardly upon the flow of fluid in the nozzle passage or the nozzle orifice. However, it is within the scope of the present invention for the direction changing means to act radially outward, as when a pin or other axially extending member having a roughened or other turbulence inducing surface extends into a generally circular nozzle orifice aperture partially to obstruct the orifice aperture and thus form an annular nozzle orifice which may have roughened surfaces along both peripheries thereof.

For convenience, the invention will be described hereinafter in terms of a radially inwardly acting direction changing means.

The direction changing means can be provided by a combination of the features described above, for example a roughened surface to the nozzle passage wall with a flap at the outlet and/or a sharp bend in the bore and/or with a triangular or other sharp edged nozzle aperture. A particularly preferred form of nozzle assembly of the invention comprises a conical nozzle passage having an included angle of from 90° to 120° and a length to diameter ratio of less than 1:1 formed in a jewel or metal body plate, with a nozzle orifice plate having a sharp lipped square or rectangular shaped aperture mounted upon the body plate with the axes of the nozzle passage and the nozzle aperture substantially co-incident.

The direction changing means causes a change of at least 10°, preferably 30° to 90°, e.g. from 45° to 60°, in the direction of flow of the fluid it affects, but greater changes of direction may be achieved by a combination of direction changing means, for example when two flaps are used in immediate succession to one another to change direction first in one direction and then in the opposite direction. It is also preferred that the change in direction be a sharp change, that is that the change in direction occurs within an axial distance of less than five, preferably less than one, diameters of the flow width. The optimum shape and position of the flow direction change means and the extent of change of direction each achieves will depend, inter alia, upon the pressure at which the fluid is being discharged, the diameter and shape of the bore and/or the nozzle orifice aperture, and the droplet size required; and can readily be determined by simple trial and error tests. Typically, the fluid will be discharged at a pressure of from 100 to 500 bar, for example at from 200 to 400 bar; to form droplets with mass median diameters of less than 6 micrometers; through nozzle orifice apertures having average diameters of from 5 to 50 micrometers, notably less than 20 micrometers, and having a cross-sectional area of from 5 to 2,500 square micrometers, notably less than 500 square micrometers.

As indicated above, it is preferred that the nozzle passage and the nozzle orifice aperture be formed in a nozzle member which is then a screw thread, interference push fit, bayonet or other fit into the discharge bore of a mechanically actuated spray forming device, notably the spring loaded pump device of our copending International Application No. PCT/GB 91/00433.

The nozzle assembly of the invention has been described above in terms of a nozzle passage feeding fluid through a nozzle orifice aperture at the outlet to the passage. However, it is within the scope of the present invention for the nozzle passage to be downstream of the nozzle orifice, as when the nozzle orifice aperture is formed at one side of a plate and a conical nozzle passage is formed wholly or partially in register with the orifice aperture from the other side of the plate. Such a plate can be used with either the nozzle passage or the nozzle orifice upstream in the flow of fluid. Alternatively, the nozzle assembly can be formed from two nozzle orifice plates with a gap between them, the nozzle passage being provided by the gap, or plenum chamber, between the plates. In this case the nozzle orifice apertures can be axially in register with one another or can be transversely off set from one another. It is also within the scope of the present invention to locate the nozzle orifice within the nozzle passage but adjacent the outlet end thereof so that the outlet to the nozzle passage does not deleteriously affect the spray formed at the nozzle orifice.

The nozzle assembly of the invention can be formed as a unitary component, as when the nozzle orifice aperture and the nozzle passage are formed in a metal or other block; or can be formed from separate components, for example from a plate having the nozzle orifice aperture formed in it and from a block or plate having the nozzle passage formed therein, the two being held together by any suitable means, for example by securing the nozzle orifice plate onto the nozzle passage block by adhesive.

The nozzle assembly of the invention may incorporate other features to enhance the operation thereof, for example a mounting sleeve or support block to aid the assembly to withstand the pressures and stresses applied to it by the sudden pressures of the discharge of fluid from the spray forming device or to aid mounting of the assembly in the spray forming device.

DESCRIPTION OF THE DRAWINGS

To aid understanding of the invention, it will now be described by way of illustration only with reference to the preferred embodiments shown in the accompanying drawings in which.

Figure 1A:
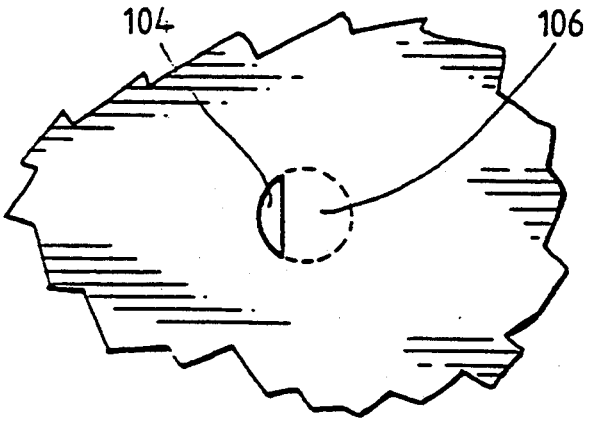
FIGS. 1*a* and 1*b* are a plan view and axial cross-sectional view respectively through one form of the nozzle assembly of the invention.
Figure 1B:
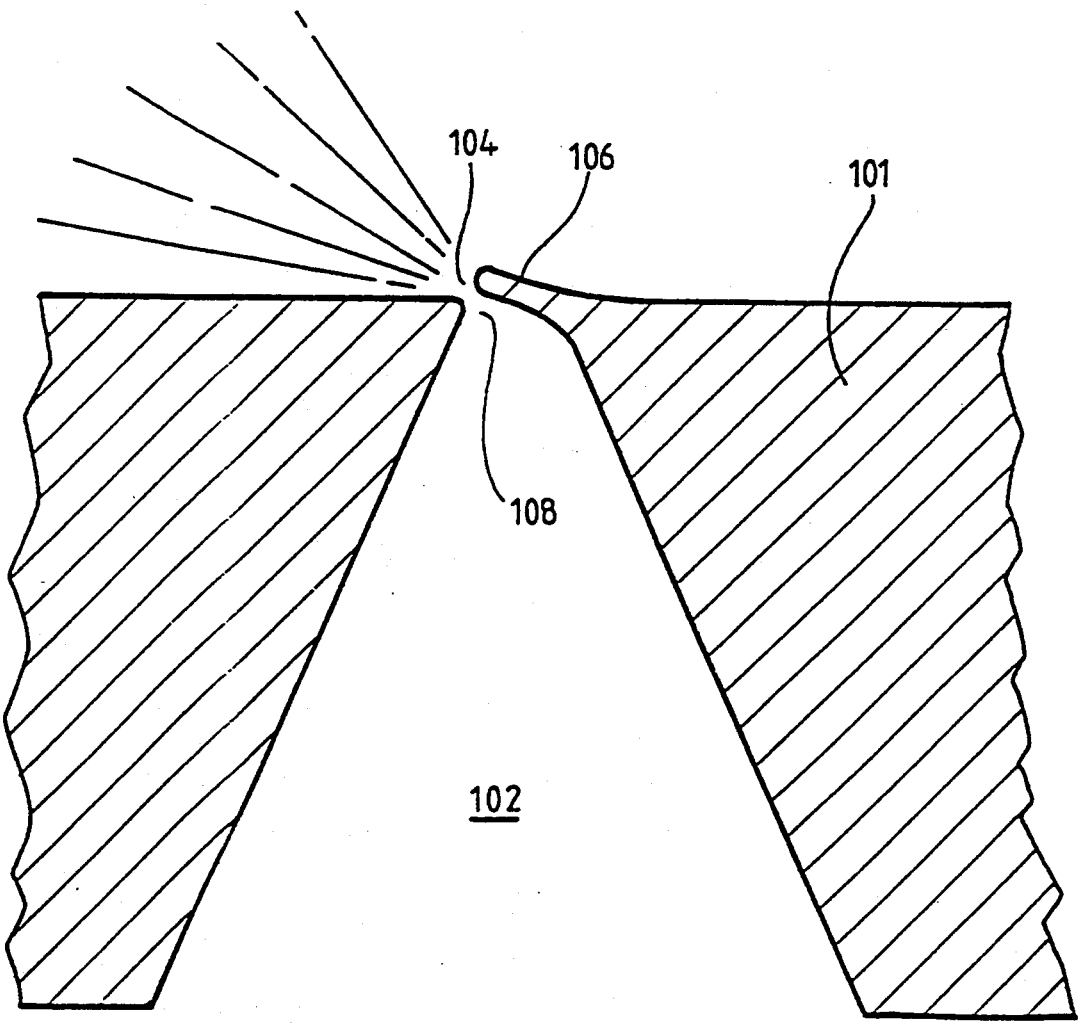

DESCRIPTION OF THE PREFERRED EMBODIMENTS OF THE INVENTION:

In FIGS. 1*a* and 1*b*, a thin plate 101 has a passage 102 having a converging cross-section formed in it by selective chemical etching or other suitable techniques. The included angle of the converging passage is from 90° to 120° and the maximum diameter to length ratio of the passage is at least 1:1. At the thin end of the passage an exit orifice aperture 104 is formed with a flap 106 positioned so that the flow of liquid is forced to change direction as it travels along the bend 108 created by flap 106 as it passes through the orifice aperture 104. This change in direction of that part of the flow diverted by the flap causes a significant secondary flow at the exit from the orifice and this aids break up of the flow of fluid into fine droplets.

The flap can be formed by partially punching a circular orifice aperture through the plate 101. Alternatively, the passage 102 can be formed in one plate and a circular aperture formed by a laser beam in another. The two plates can then be mounted one upon the other with the aperture only partially in register with the passage to achieve a similar flap to that shown in FIG. 1*b*. However, the right hand lip of the orifice aperture would be curved rather than straight as shown in FIG. 1*a*.

To produce droplets with a mass median diameter of under 7 micrometers, the liquid is delivered to the passage 102 at a pressure of about 350 to 400 atmospheres (bars). The thickness of plate 101 is approximately 100 micrometers and the final orifice aperture 104 mean diameter is approximately 5 micrometers.

Figure 2A:
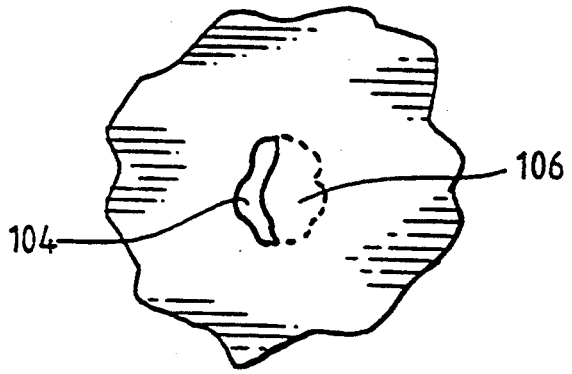
FIGS. 2*a*, 2*b* and 3*a*, 3*b* are a plan view and axial cross-sectional view respectively through alternative forms of the nozzle assembly.
Figure 2B:
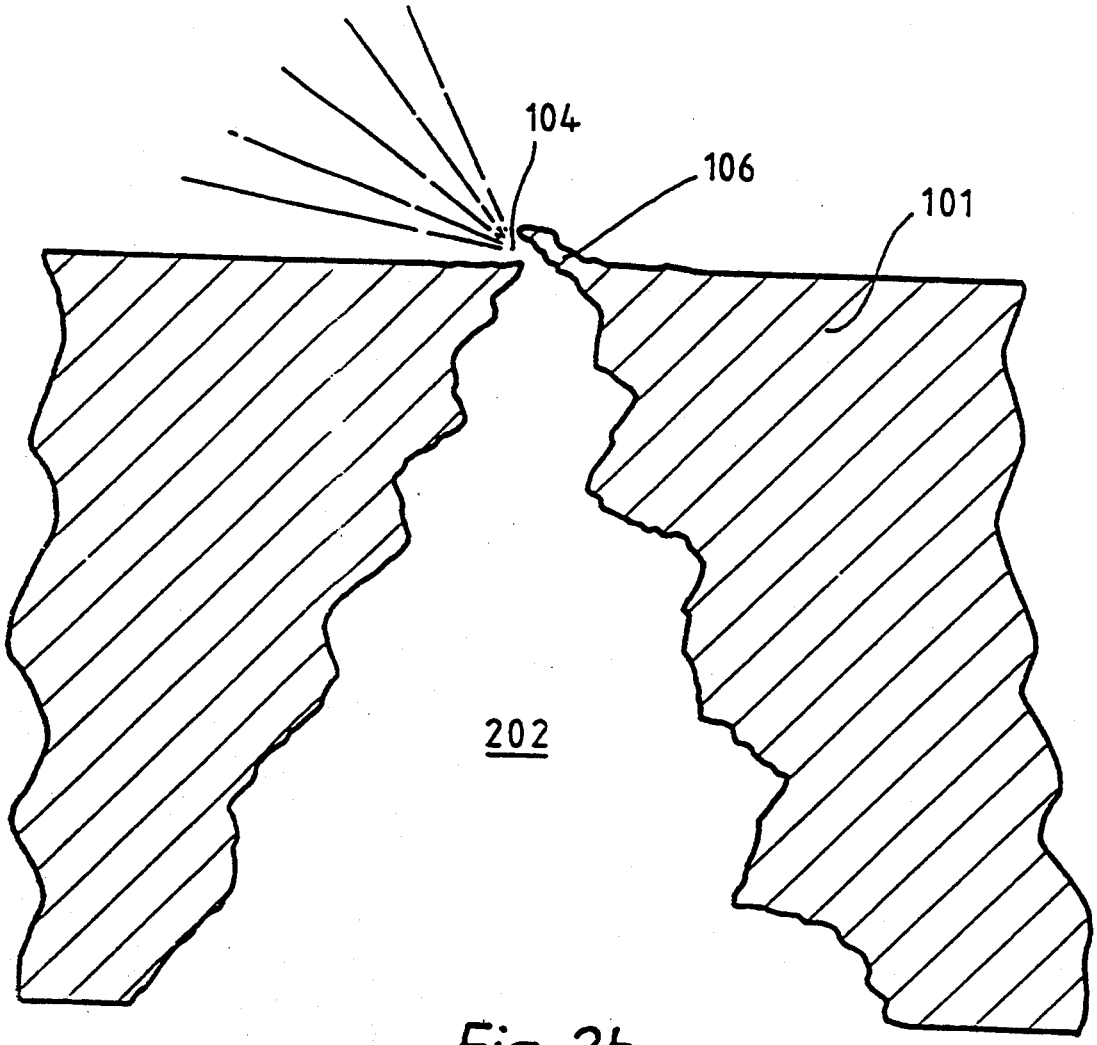

In FIGS. 2*a* and 2*b*, a similar atomising nozzle to that of FIG. 1 is shown, but with a rough finish to the walls of passage 202 and the lips of the orifice aperture 104. The rough finish aids creation of turbulence and hence secondary flows within the fluid and aids atomization. In such a form of the nozzle assembly, the roughness is typically about 3 micrometers high and this can be achieved by mechanical punching of the passage and the orifice. Where the roughness in the passage 202 causes sufficient secondary flow(s) in the fluid passing through the aperture 104, the nozzle orifice can be provided by a conventional nozzle orifice with a smooth bore circular aperture.

Figure 3A:
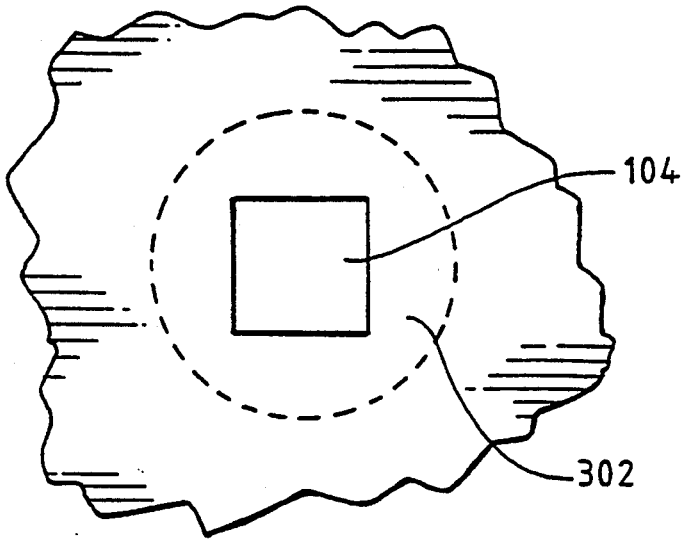
Figure 3B:
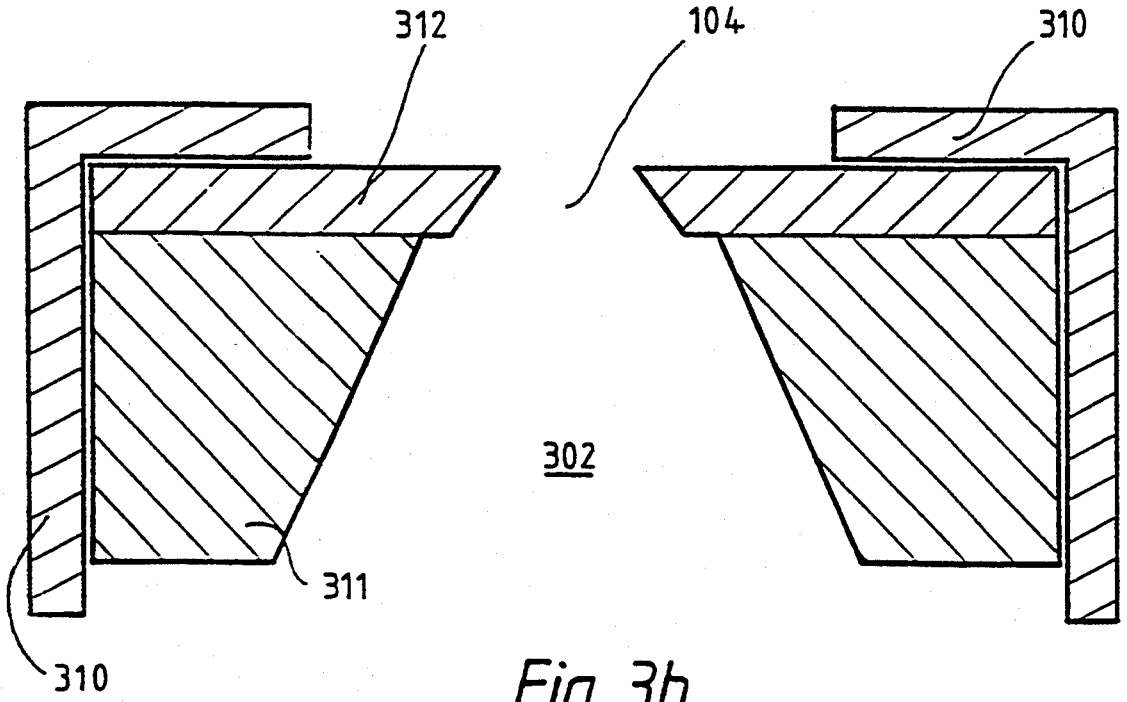

In FIGS. 3*a* and 3*b*, the nozzle assembly is similar to that shown in FIGS. 1*a* and 1*b*, except that the nozzle passage 302 is formed by injection or similar moulding of a plastic material to give a smooth finish to the walls of the passage. The nozzle orifice aperture has a rectangular, polygonal or squared cross-section as shown in FIG. 3*a*. The nozzle orifice can be formed by selectively etching a photosensitive plastic or a silicon wafer using known techniques. It will usually be preferred to provide a support cap or the like 310 to minimise the risk of damage to the nozzle passage block 311 and the nozzle orifice plate 312 and this cap can carry an external screw thread whereby the nozzle assembly can be secured into the outlet bore of a spray forming device.

The nozzle assembly of FIGS. 3*a* and 3*b*, can be orientated with the nozzle orifice upstream or downstream of the nozzle passage, since it is largely the sharp angles of the lip of the orifice aperture which cause the secondary flows required to break up the flow of fluid into fine droplets.

Figure 4:
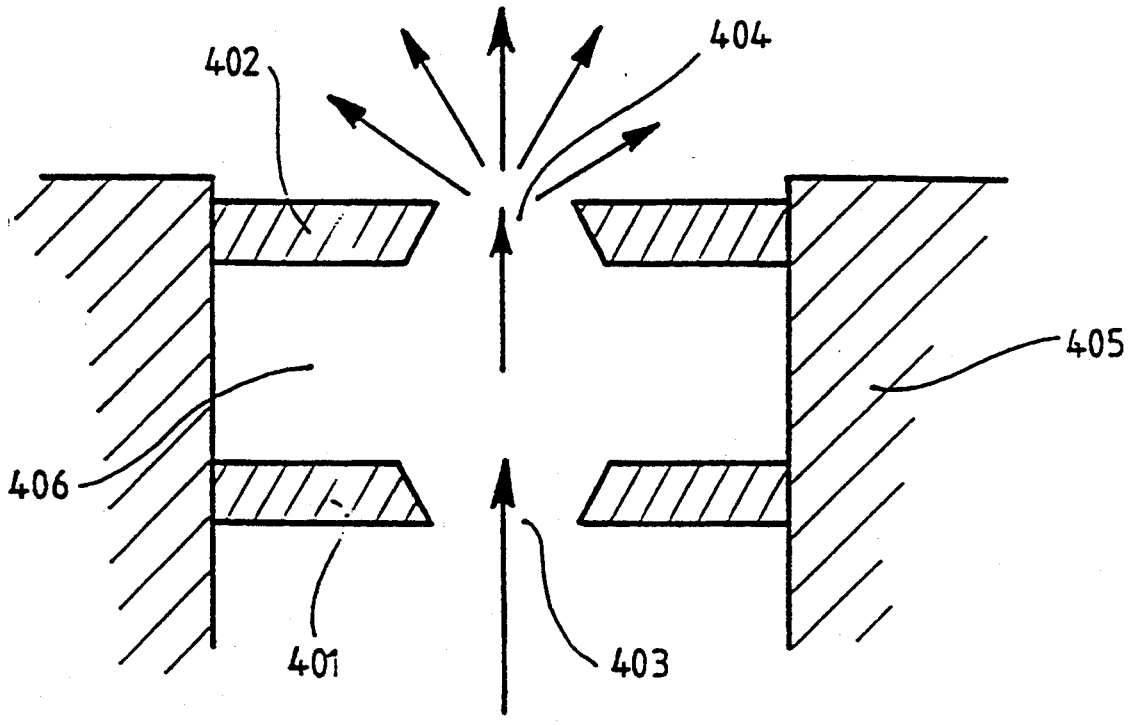
FIG. 4 shows a further alternative form of the nozzle assembly of FIG. 1.

In the form of nozzle assembly shown in FIG. 4, nozzle orifice apertures are formed in two separate plates. The upstream nozzle orifice aperture can be comparatively coarse so that it does not cause the fluid flowing through it to break up into droplets. However, due to the sharp lip of this orifice, it will induce secondary flows within the fluid. The downstream nozzle orifice aperture is fine enough, for example less than 20 micrometers, to cause the fluid passing through it to break up into fine droplets. The two plates are mounted approximately one fine nozzle orifice diameter apart. The gap between the plates forms, with the annular walls of the mounting in which the plates are secured, a passage of sharply greater diameter that the upstream orifice and this change in cross-section aids formation of secondary flows within the flow issuing from the upstream orifice aperture.

The invention has been described above in terms of the use of a single direction changing means. However, two or more such means may be used in combination, for example the flap shown in FIG. 1 can be used in combination with one or more further flaps located around the periphery of the lip of the nozzle orifice aperture and acting in opposed senses to that shown so as to induce secondary flows which oppose one another and simulate the formation of impinging streams of fluid at or immediately downstream of the nozzle orifice aperture.

We claim:

1. A method for discharging a fluid as a spray of droplets comprising:

flowing a fluid through a nozzle assembly comprising a nozzle passage in fluid flow communication with a nozzle aperture, wherein the cross-sectional area of said nozzle aperture is in the range of 5 to 2,500 square micrometers and wherein said fluid is applied to said nozzle assembly at a pressure of from 100 to 500 bar; and inducing a secondary flow in at least part of the flow of said fluid through said nozzle aperture by a direction changing means located in a position selected from within the bore of said nozzle passage, adjacent an end of said nozzle passage, and adjacent said nozzle aperture.

2. A method as claimed in claim 1, wherein said direction changing means induces said secondary flow at said nozzle aperture such that at least 10% of said fluid flows at an exit angle of 90° to the overall line of flow of the remainder of said fluid at said nozzle aperture.

3. A method as claimed in claim 1, wherein said direction changing means induces said secondary flow at said nozzle aperture such that from 20 to 80% of said fluid flows at an exit angle of 90° to the overall line of flow of the remainder of said fluid at said nozzle aperture.

4. A method as claimed in claim 1, wherein said direction changing means achieves in said part of the flow a change in the angle of flow of from 30° to 90° to the overall line of flow of the remainder of said fluid.

5. A method as claimed in claim 1, wherein said nozzle passage has at least one rough surface exposed to the flow of fluid so that the roughness is at least sufficient to induce said secondary flow into the flow of fluid.

6. A method as claimed in claim 1, wherein said nozzle passage comprises a passage converging at an included angle of at least 60° towards said nozzle aperture, and wherein said nozzle aperture has a polygonal shape.

7. A method as claimed in claim 1, wherein said nozzle aperture is non-circular and the ratio of the maximum radial dimension to the minimum radial dimension of said aperture is from 2:1 to 10:1.

8. A method as claimed in claim 1, wherein said nozzle aperture comprises a sharp lip.

9. A method as claimed in claim 1, wherein said nozzle aperture has a mean diameter of less than 20 micrometers.

10. A method as claimed in claim 1, wherein said fluid comprises a medicament.

* * * * *